US005913278A

United States Patent [19]

Mitchell

[11] Patent Number: 5,913,278

[45] Date of Patent: Jun. 22, 1999

[54] FLOATING DOCK

[76] Inventor: George Mitchell, 602 Devon Park, 45 Stanley Point Rd., Devonport, Aukland, New Zealand

[21] Appl. No.: 08/535,004

[22] PCT Filed: Apr. 15, 1994

[86] PCT No.: PCT/NZ94/00033

§ 371 Date: Mar. 22, 1996

§ 102(e) Date: Mar. 22, 1996

[87] PCT Pub. No.: WO94/23994

PCT Pub. Date: Oct. 27, 1994

[30] Foreign Application Priority Data

Apr. 15, 1993 [NZ] New Zealand ..... 247410

[51] Int. Cl.[6] ..... B63C 1/02

[52] U.S. Cl. ..... 114/45; 405/3

[58] Field of Search ..... 114/45–48; 405/3–7

[56] References Cited

U.S. PATENT DOCUMENTS 5,285,743 2/1994 Connolly ..... 114/45

FOREIGN PATENT DOCUMENTS 1248894 8/1986 U.S.S.R. ..... 114/16

*Primary Examiner*—Jesus D. Sotelo

[57] ABSTRACT

A method of dry docking vessels comprising: (i) providing a floating dock (1) comprising: a main balast vessel (3); a load supporting raft (2); the load supporting raft (2) and the main ballast vessel (3) being selectively attachable to each other, the main ballast vessel (3) and the load supporting raft (2) having separately variable buoyancy; (ii) submerging the main ballast vesse (3) and the load supporting raft (2) (iii) positioning a vessel (30) to be dry docked over the load supporting raft (2); (iv) increasing the buoyancy of thee main ballast vessel (3) and the load supporting raft (2) so as to raise the vessel (30) out of the water, the main ballast vessel (3) at least in part stabilising and supporting the vessel (30), the raising of the load supporting raft (2) occuring simultaneously or alternatively at least in part subsequent to raising the main ballast vessel (3); and (v) optionally attaching or securing the vessel (30) to the load supporting raft (2).

12 Claims, 12 Drawing Sheets

FLOATING DOCK

TECHNICAL FIELD

This invention relates to floating docks, and in particular to docks consisting of two parts which are raised from a submerged condition by air displacement of water.

DISCLOSURE OF INVENTION

In one aspect the invention provides a floating dock comprising:

a main ballast vessel capable of being raised or lowered in the water, a load supporting raft capable of being raised or lowered in the water, said load supporting raft being selectively attachable to said main ballast vessel, the buoyancy of said main ballast vessel and said load supporting raft being separately variable.

In another aspect the invention consists in a method of dry docking vessels comprising:

(i) providing a floating dock comprising:

a main ballast vessel;

a load supporting raft;

said load supporting raft and said main ballast vessel being selectively attachable to each other, said main ballast vessel and said load supporting raft having separately variable buoyancy;

(ii) attaching said load supporting raft to said main ballast vessel;

(iii) positioning a vessel to be dry docked over said load supporting raft;

(iv) increasing the buoyancy of said main ballast vessel and said load supporting raft so as to raise said vessel out of the water, the main ballast vessel at least in part stabilising and supporting said vessel the raising of said load supporting raft occurring simultaneously or alternatively at least in part subsequent to raising said main ballast vessel; and (v) optionally attaching or securing said vessel to said load supporting raft; and (vi) unattaching said load supporting raft from said main ballast vessel, thus allowing said vessel to be dry-docked to be supported solely by said load supporting raft so that if desired said main ballast vessel can be used with further load supporting rafts.

Preferably said increase in buoyancy of said load supporting raft is increased by allowing at least some of any liquid contained within said vessel supporting raft to egress said load supporting raft as said load supporting raft is raised.

Preferably said vessel is stabilised on said load supporting raft.

Preferably said main ballast vessel is substantially "U" shaped in cross section Preferably said load supporting raft carrying said vessel and said main ballast vessel can be separated when the said dock is raised to the desired level and the said raft is in a high state of buoyancy.

Preferably said load supporting raft is capable of carrying vessel supported and attached to the upper surface thereof.

Preferably said variable buoyancy is provided by the input of compressed air.

Preferably a number of load supporting rafts are provided.

In yet another aspect the invention consists in apparatus for performing the above method comprising:

a floating dock comprising:

a main ballast vessel;

a load supporting raft;

said load supporting raft and said main ballast vessel being selectively attachable, said main ballast vessel and said load supporting raft having separately variable buoyancy and separate levelling systems;

main ballast vessel having attached thereon means to stabilise and support a vessel to be dry docked when said vessel is being raised out of the water:

Preferably said load supporting raft has means to level and provide support when said load supporting raft and attached vessel are separating from said main ballast vessel.

Preferably said main ballast vessel is substantially "U" shaped in cross section.

Preferably said variable buoyancy is provided by the input of compressed air.

Preferably a number of load supporting rafts are provided.

The invention consists in the foregoing and also envisages constructions of which the following gives examples.

BRIEF DESCRIPTION OF INVENTION

One preferred form of the present invention will now be described with reference to the accompanying drawings in which.

BEST MODES FOR CARRYING OUT INVENTION

Figure 1:
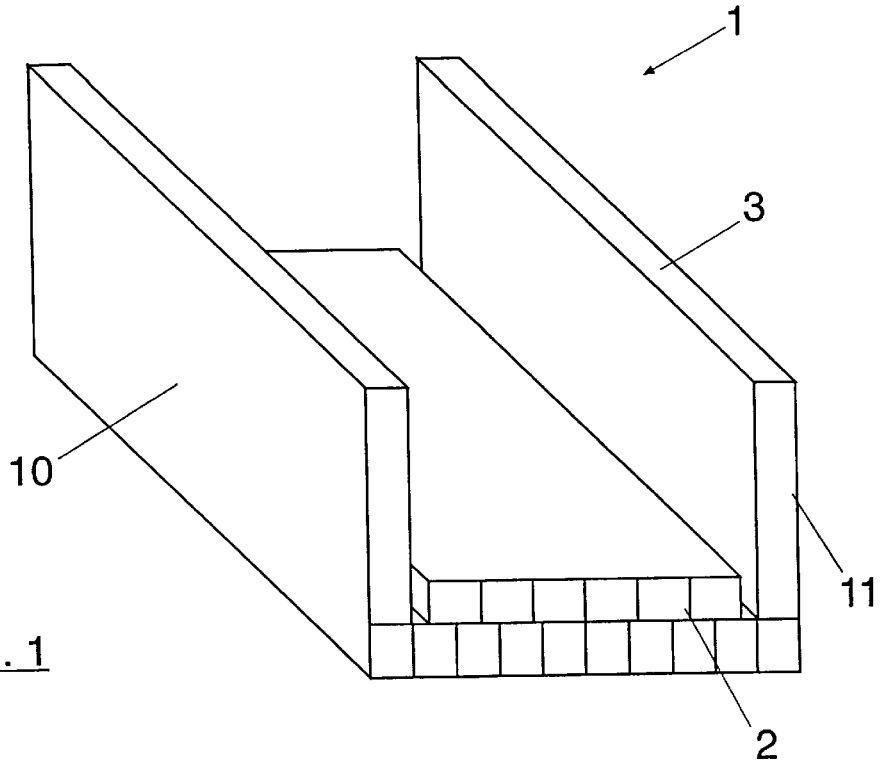
FIG. 1 shows a perspective view of the floating dock with load supporting raft thereon.
Figure 2:
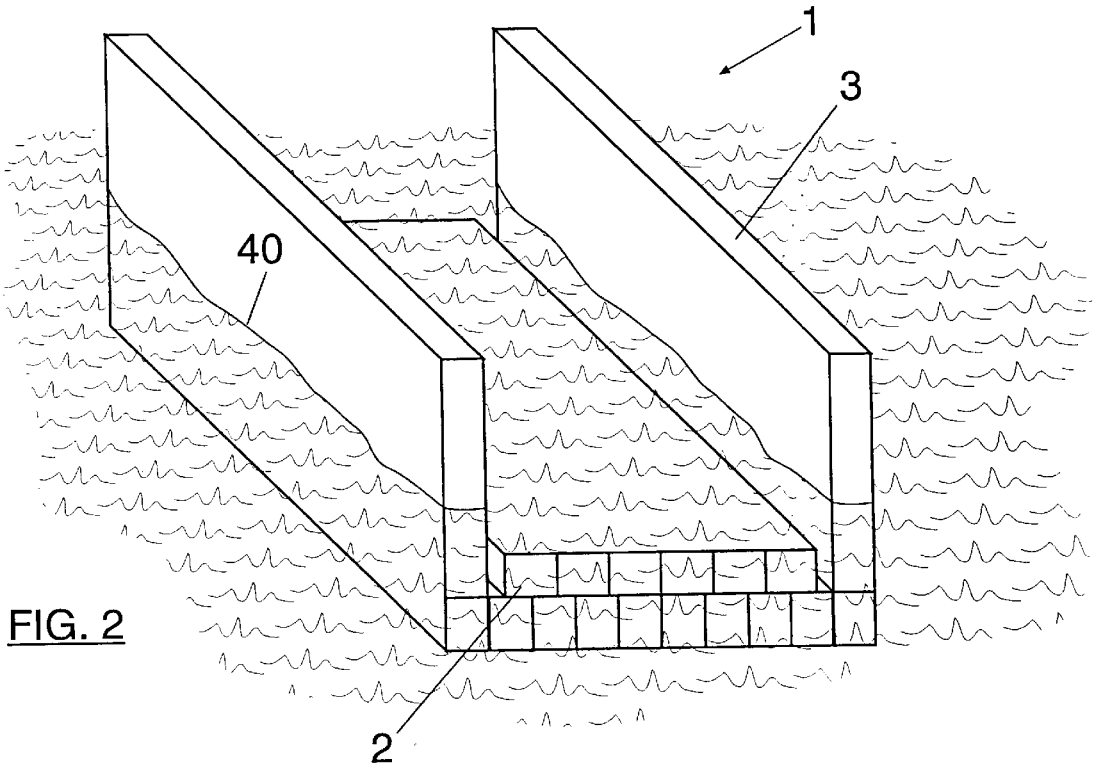
FIG. 2 shows a perspective view of the floating dock with load supporting raft in a partially submerged condition.
Figure 3:
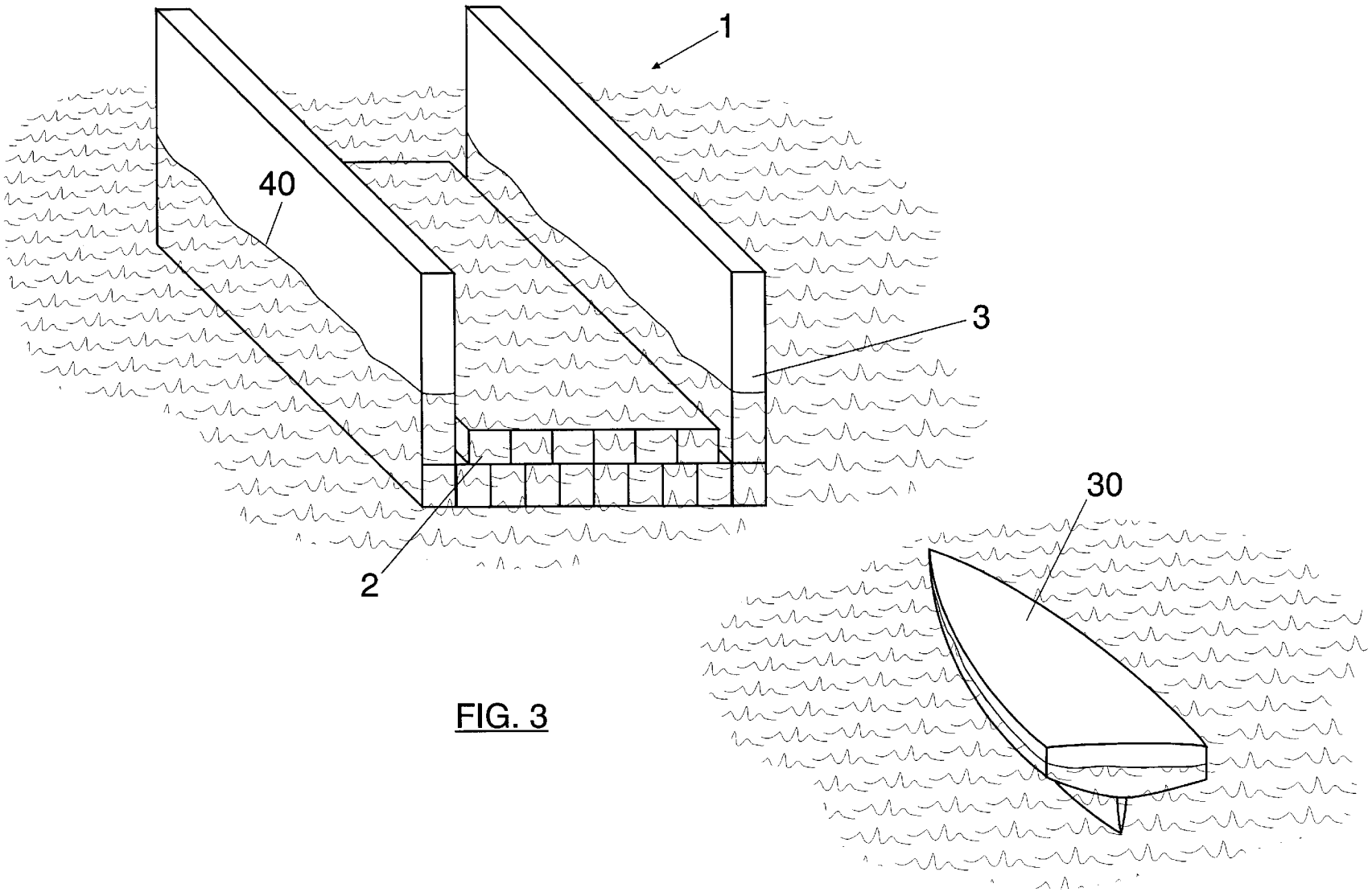
FIG. 3 shows a perspective view of the floating dock and load supporting raft in a partially submerged condition with the boat to be docked.
Figure 4:
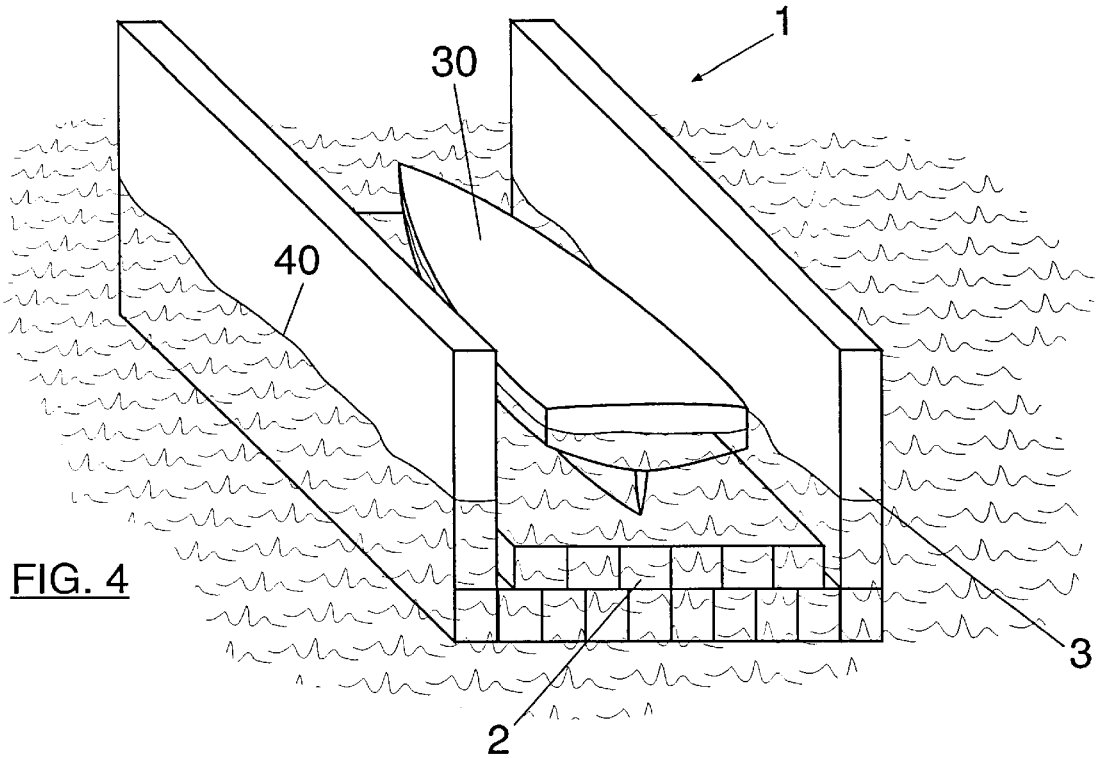
FIG. 4 shows a perspective view of the floating dock with load supporting raft thereon with the vessel to be docked attached to the raft.
Figure 5:
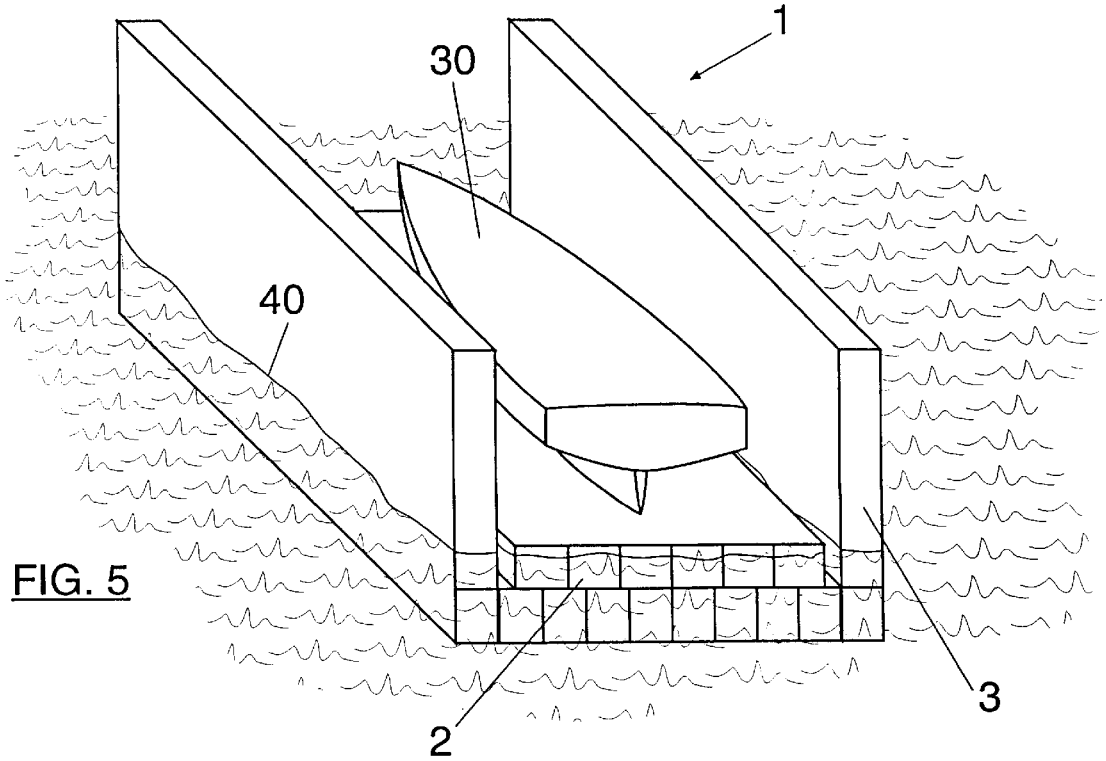
FIG. 5 shows the floating dock with load supporting raft thereon and attached vessel to be docked in a raised condition.
Figure 6:
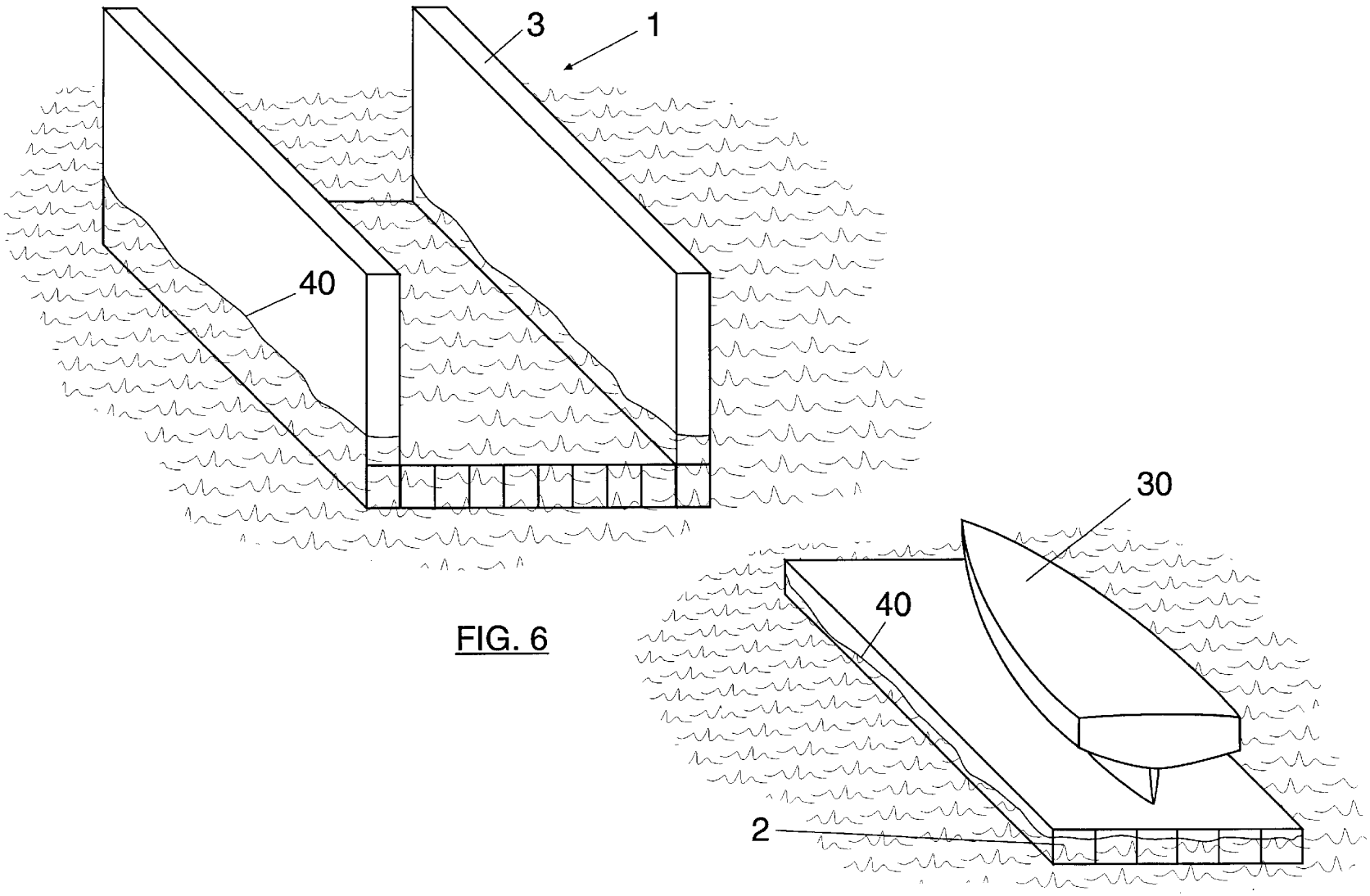
FIG. 6 shows a perspective view of the raised main ballast vessel and raised load supporting raft with vessel attached, the raised main ballast vessel and load supporting raft being separated.
Figure 7:
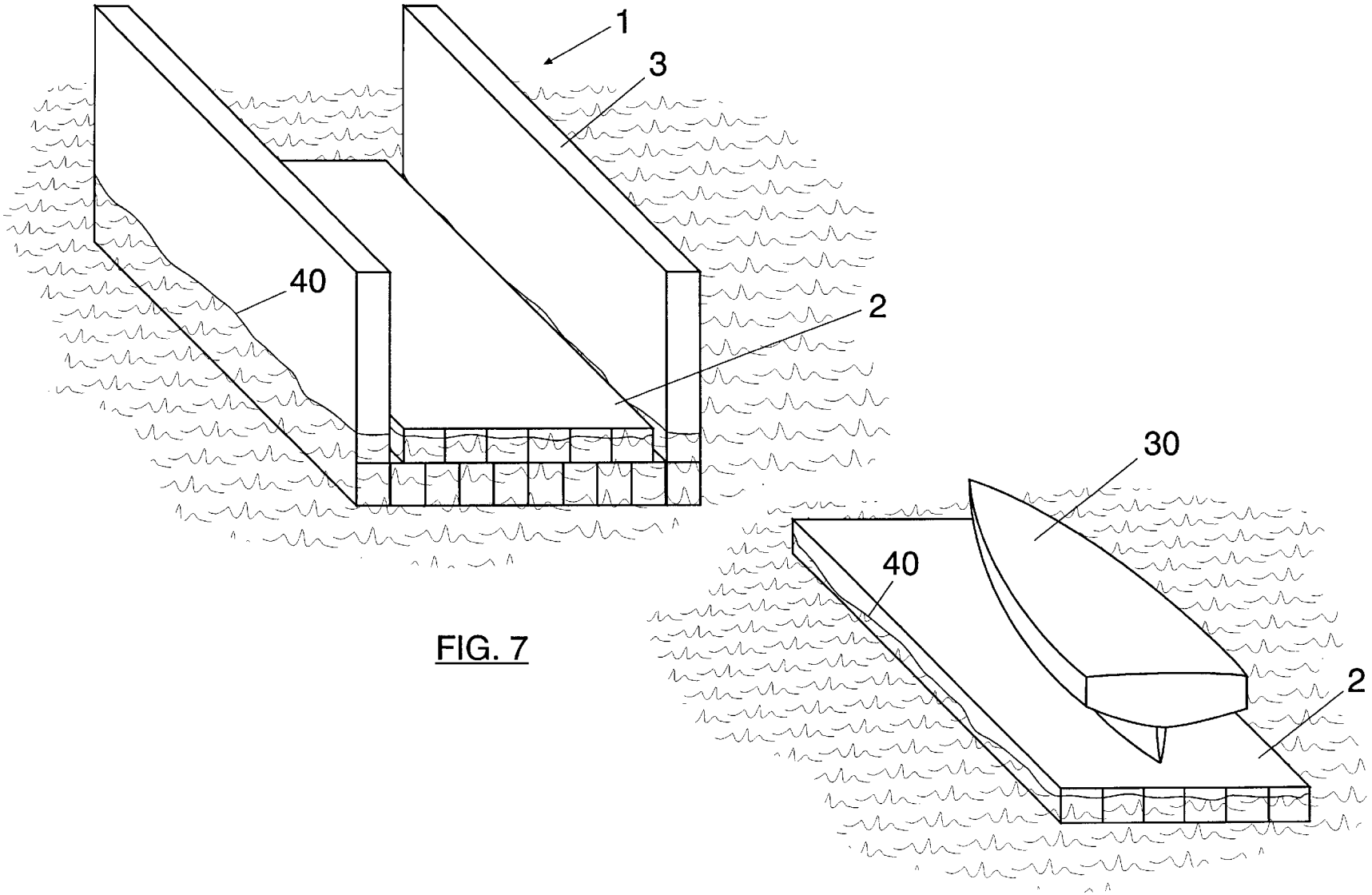
FIG. 7 shows a perspective view of the raised floating dock and separated raised load supporting raft with vessels thereon, the raised floating dock having a new load supporting raft attached thereon.

As shown in the Figures the invention 1 comprises two main parts a load supporting raft 2 and a main ballast vessel 3.

Both the load supporting raft 2 and the main ballast vessel may be constructed in a variety of suitable methods out of a variety of suitable materials. In one form of the invention the load supporting raft 2 and main ballast vessel are constructed from corrosion protected steel.

The main requirement for the construction is that the raft and the member are capable of exhibiting variable buoyancy.

In one form of the invention this variable buoyancy is achieved through the entry and exit of water into hollow sections of the raft or ballast vessel thus decreasing the buoyancy of the said raft and/or main member thus causing them to sink. Compressed air can be injected into the said water filled hollow sections thus forcing out the water and increasing the buoyancy of the said members thus causing them to float. In one form of the invention the members consist of hollow box sections. In other forms they can consist of large diameter pipes. The rafts and ballast vessels can be constructed of steel which is heavily galvanized, painted or otherwise protected.

The main ballast vessel and has attached stabilising means. In one form of the invention as shown in the figures these comprise vertical sections 10, 11.

In addition preferably the load supporting raft will be fitted with arrangements for the collection and storage of waste materials and liquids resulting from the servicing of the client vessel.

In other forms of the invention the main ballast vessel and load supporting raft is at least partially defined by framing members. In forms of the invention the main ballast vessel and load supporting raft consists of buoyancy members constructed in the form of tanks, e.g. sealed end large diameter pipes.

In forms of the invention the load supporting raft may have an upper load bearing surface defined by a perforated material. For example, this may comprise a strong steel mesh. In other forms of the invention the upper surface of the load supporting raft comprises a grid of bars.

In some forms of this invention the floating dock will have steel work cambered and fixed to platform where it abuts the vertical structure to provide for the centering of the raft when docking and undocking.

In some forms of this invention the floating dock will be fitted with air operated winches to facilitate the securing of vessels when docking and undocking.

The number of load supporting rafts available with the invention depends on its use. If the floating dock is to be used irregularly or used for salvage or rescue work, there need only be as few as one load supporting raft available. In other forms of the invention where there is regular use, for example, to provide dry docking or storage for yachts there may need to be many load supporting rafts available.

The load supporting rafts in some forms of the invention may have attached to the upper surface thereof a tie down securing system. In some forms these comprise hooks or ringbolts with chain plates. These support devices provide a support for the vessel to be raised by providing attachment points for cables, chains or straps which hold the vessel in position and also provides support for the vessel so it remains in the upright position when raised.

The load supporting raft is inherently stable due to the large surface area of its platform deck. The load supporting raft with attached client vessel is also stable once its buoyancy has been increased and its attitude has been altered using different buoyancies in the various tanks that make up the load bearing raft. The attitude, i.e. the trim and heel of the main ballast member and the combination of the main ballast member and load supporting raft and client vessel if attached can be modified by flooding or evacuating certain tanks in the main ballast vessel. Thus it is possible to level the load supporting raft, main ballast vessel and combination of load supporting raft main ballast vessel and attached client vessel in order to correct any lack of trim of said vessel and rafts or combinations thereof.

In some forms of the invention the load supporting rafts have attached thereon fixing points for towing facilities such as anchor points for the attachment of a rope from a tug to enable the load supporting raft to be moved.

The floating dock may be more permanently in position near a harbour facility. The floating dock may be used as a means to store vessels out of the water, for example, in a yacht harbour.

In other forms of the invention the floating dock is mobile and can be used to provide dry docking facilities in areas that would otherwise lack these facilities.

The said compressed air can be supplied from a compressor attached to the main ballast vessel or may be supplied from a land based compressor through a pipe. In other forms of the invention the compressed air is supplied from a raft or tender boat floating nearby.

Figure 8:
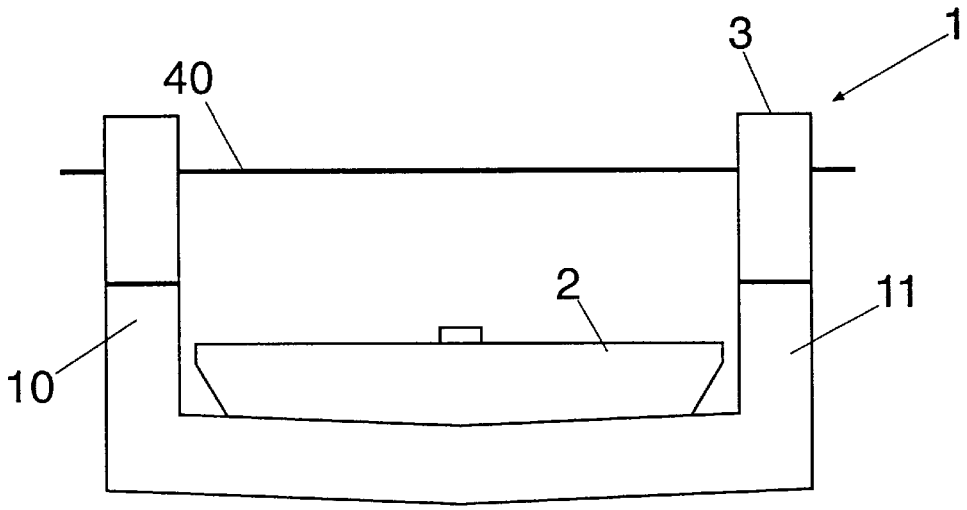
FIG. 8 shows an end elevation of a floating dock with load supporting raft in the fully submerged condition.

The sequence of the floating dock in operation is illustrated in FIGS. 8 to 22. As shown in FIG. 8 in a preferred form of the invention initially said floating dock comprises two main parts a load supporting raft (2) and a main ballast vessel (3). As shown in the figures initially said load supporting raft (2) and said ballast vessel (3) are substantially submerged and may be attached together in some manner.

Figure 9:
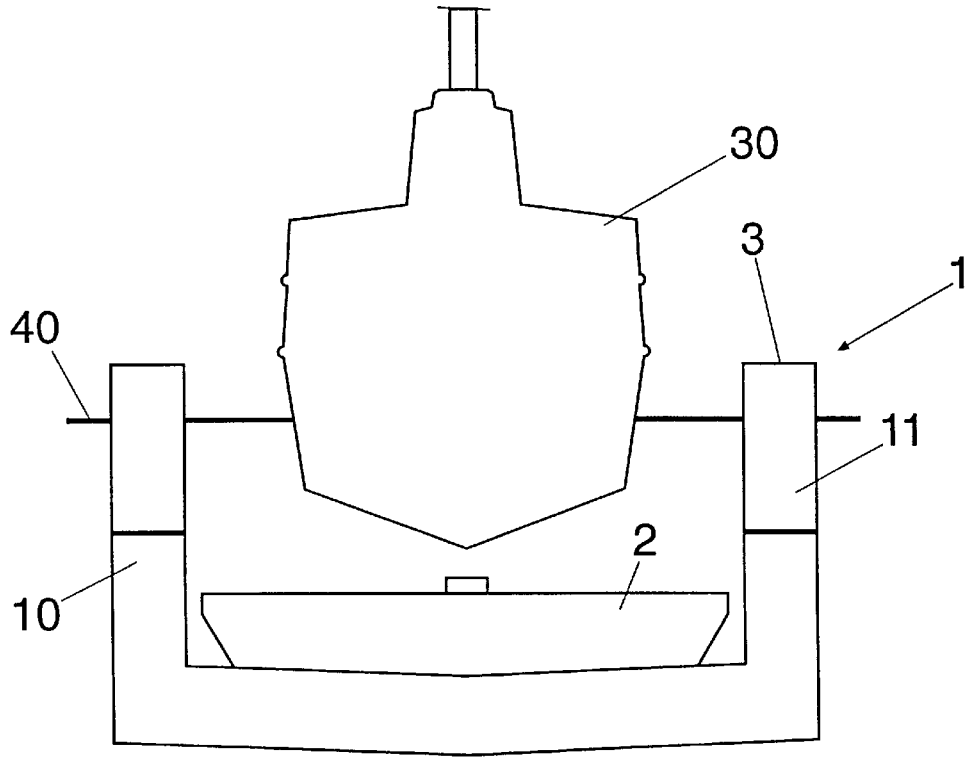
FIG. 9 shows an end elevation of the floating dock and load supporting raft as shown in FIG. 8 wherein a vessel to be raised is floated over said load supporting raft.
Figure 10:
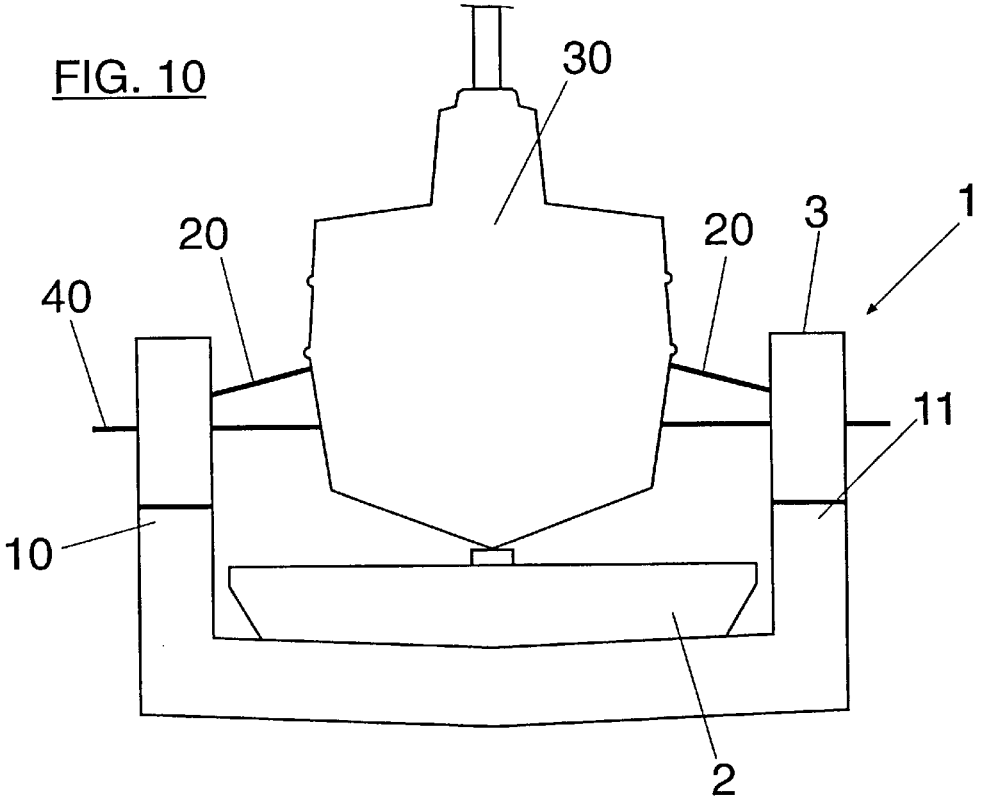
FIG. 10 is an end elevation of the floating dock and load supporting raft as shown in FIG. 9 wherein the vessel is secured to said floating dock.

In FIG. 9 a vessel (30) is positioned substantially within said dry dock (1) and floats over said load supporting raft (2). FIG. 10 shows the securement of said vessel (30) to said main ballast vessel (3) in forms in the invention this attachment may take the form of using straps (20) to attach said vessel (30) to said vertical sections (10 and 11). In forms in the invention the dry dock (1) may be floated up so that said load supporting raft contacts lower portions of said vessel.

Figure 11:
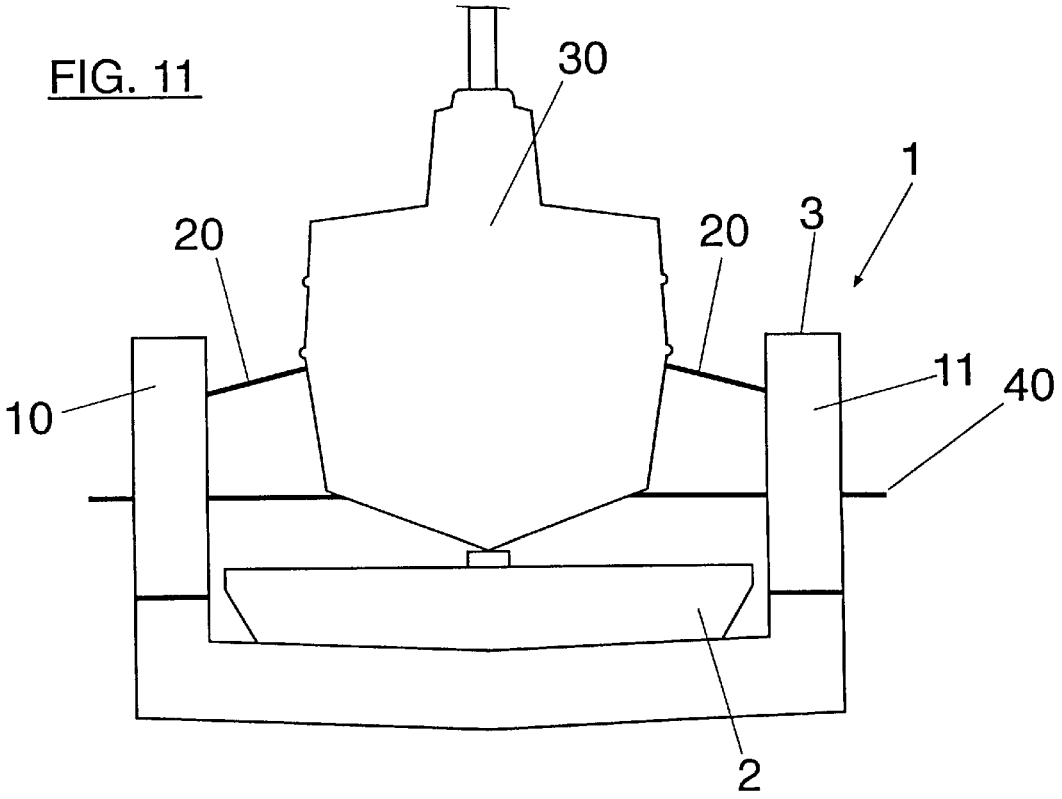
FIG. 11 shows the floating dock, load supporting raft and secured vessel as shown in FIG. 10 in a partially raised condition.

FIG. 11 shows the raising out of the water of the dry dock (1) and vessel (30) in preferred forms of the invention this raising up or floating up of the dry dock (1) and vessel (30) is achieved by means of increasing the buoyancy of said main ballast vessel (3). In preferred forms this increasing buoyancy is provided by means of the ingress of compressed air into said main ballast vessel (3) thereby forcing out water contained there within. In other forms of the invention the water may be pumped out.

Figure 12:
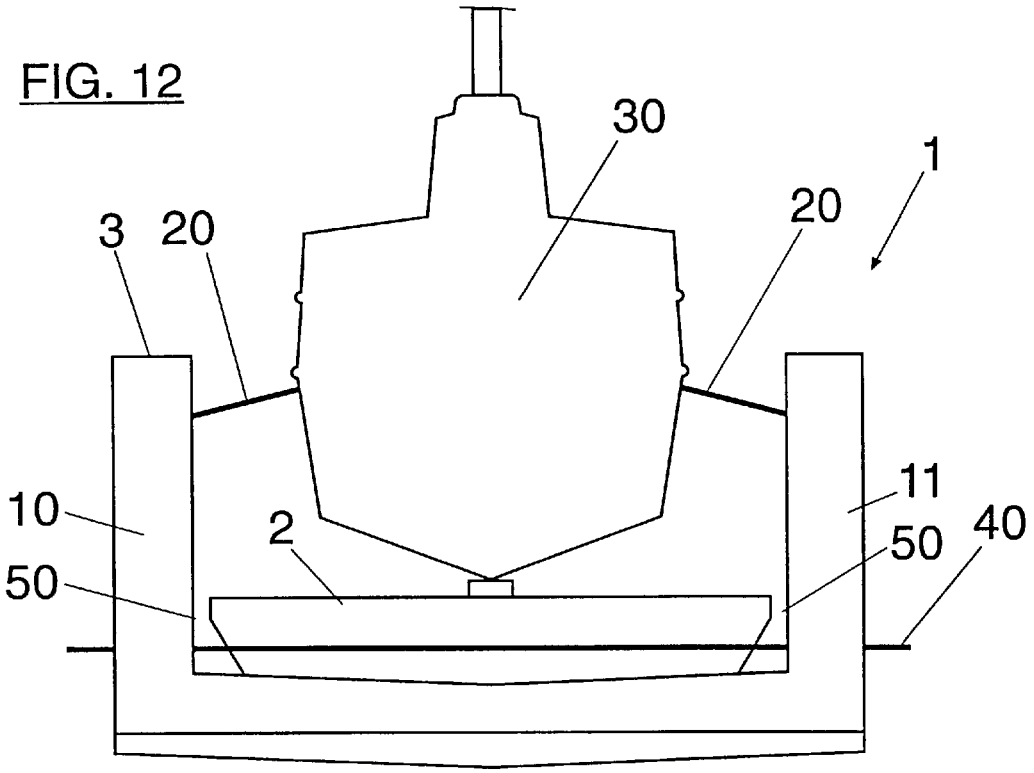
FIG. 12 shows the floating dock, load supporting raft and vessel in a fully raised condition.

FIG. 12 shows the stage of the raising of the vessel (30) and the dry dock (1) wherein the load supporting raft (2) emerges from the water. In preferred forms of the invention said load supporting raft (2) has openings for example valves (50) which enable the water contained within to be drained. In preferred forms of the invention water is not pumped or forced out of said load supporting raft but merely drains under the action of gravity.

Figure 13:
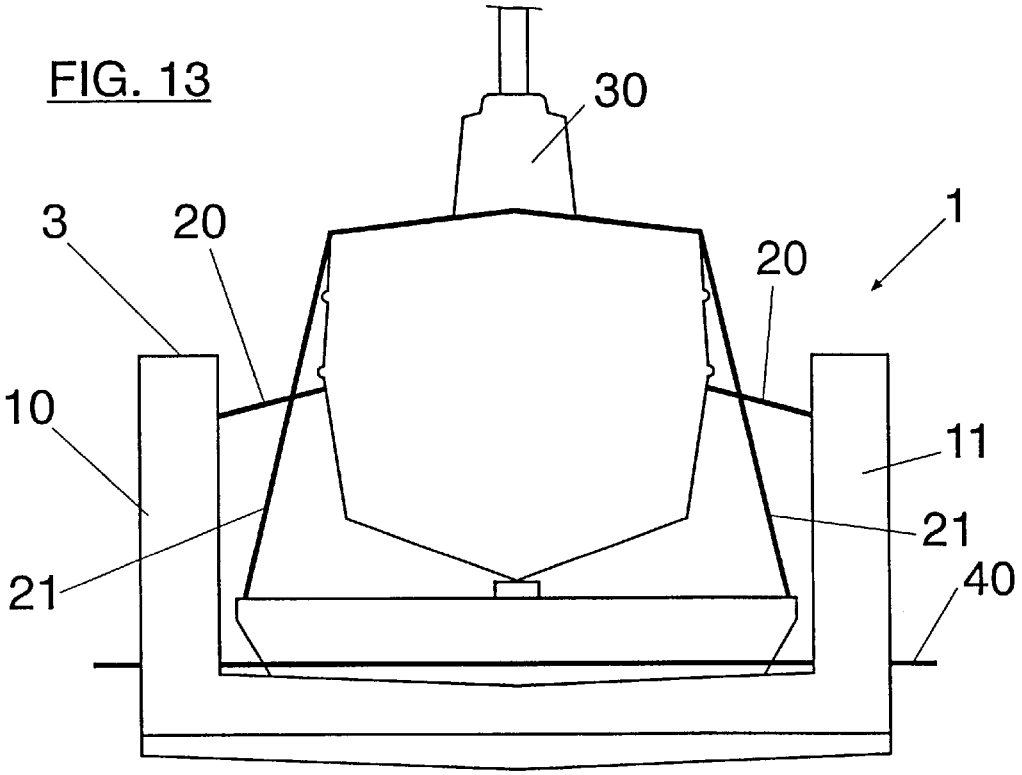
FIG. 13 is an end elevation of the floating dock, vessel and load supporting raft as shown in FIG. 12 wherein the vessel is secured to the load supporting raft and the floating dock.

As shown in FIG. 13 once afloat the vessel (30) is attached to the load bearing raft (2) by for example straps (21).

Figure 14:
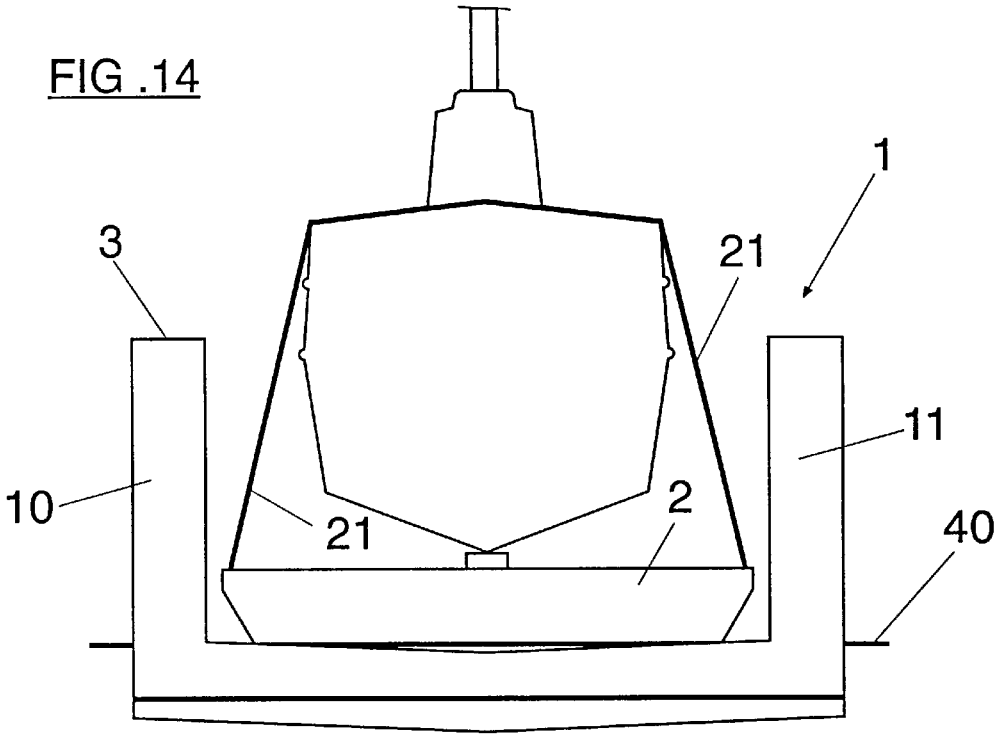
FIG. 14 is an end elevation showing the floating dock, load supporting raft and vessel as shown in FIG. 13 wherein the vessel is no longer secured to the floating dock.

As shown in FIG. 14 the straps (21) securing the vessel to the main ballast body (3) are then released. Any optional linking means between said main ballast vessel (3) and said load bearing raft (2) are then also released.

Figure 15:
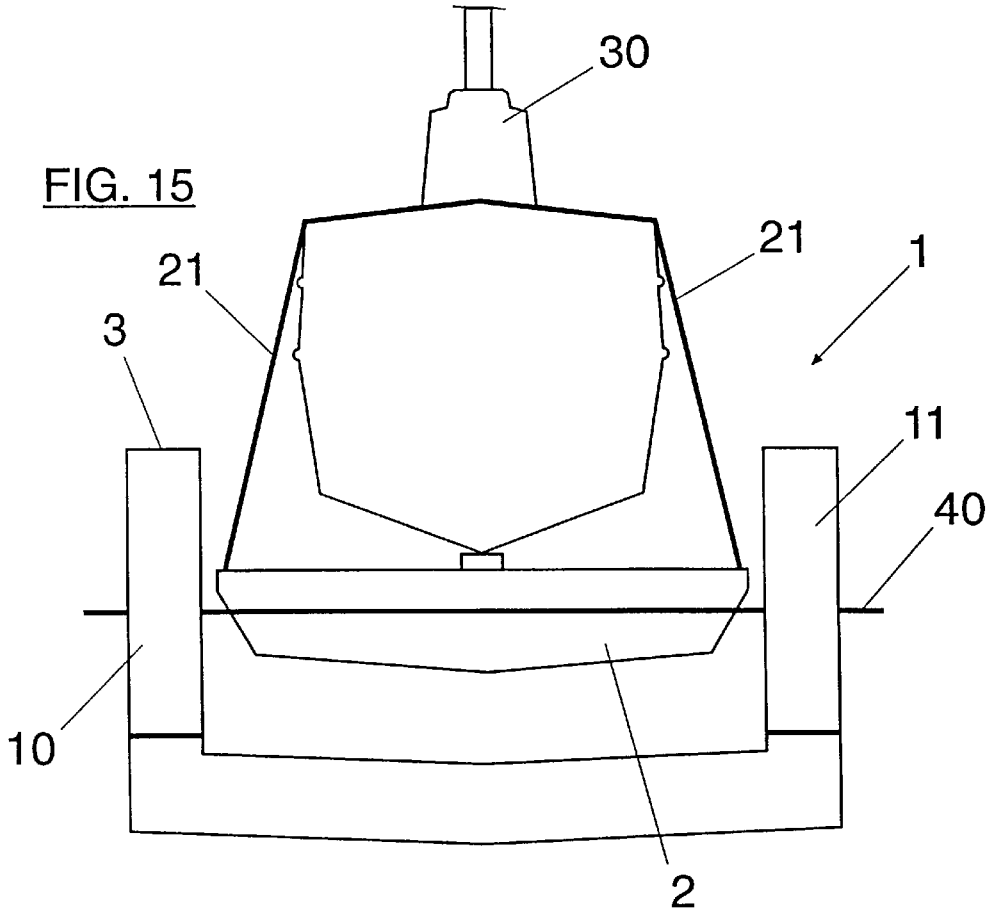
FIG. 15 is an end elevation showing the vessel, load supporting raft and floating dock as shown in FIG. 14 wherein the floating dock is partially submerged.

The main ballast vessel is then resunk as shown in FIG. 15. This enables the load supporting raft (2) and said attached vessel (30) to be floated free if desired.

Figure 16:
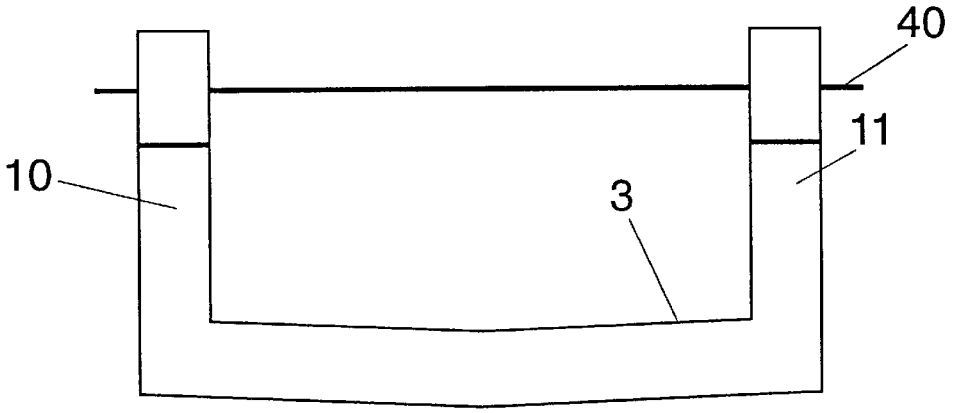
FIG. 16 shows the floating dock as shown in FIG. 15 in the fully submerged condition.
Figure 17:
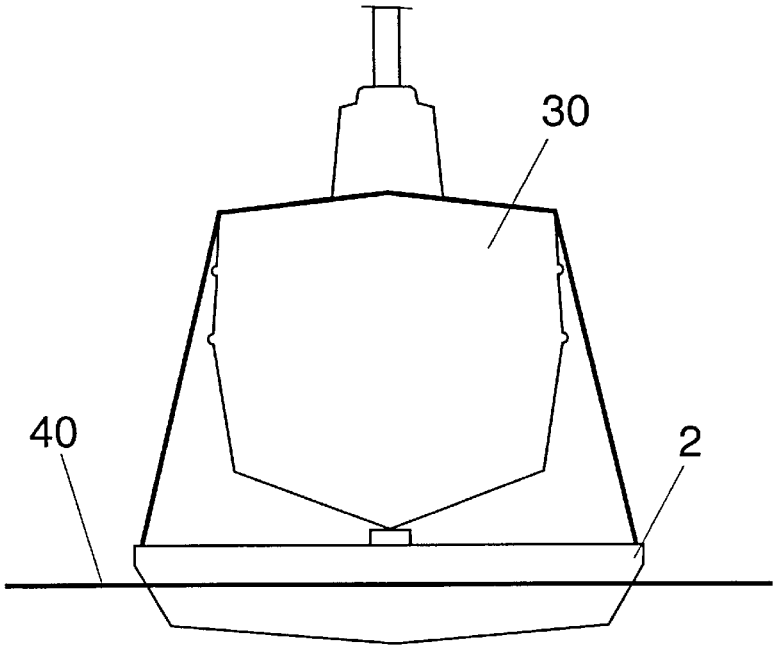
FIG. 17 is an end elevation showing the load supporting raft with vessel attached thereto floating separately from the floating dock.

FIG. 16 and 17 show the submerged main ballast vessel (3) and said free floating load bearing raft with attached vessel (30).

Figure 18:
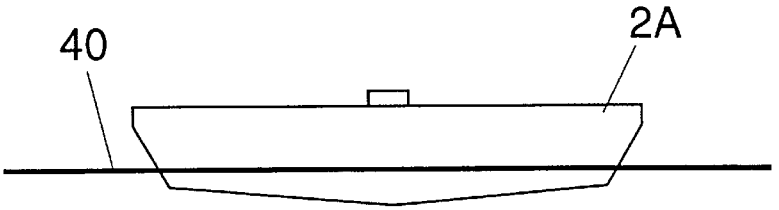
FIG. 18 is an end elevation showing the floating of a replacement load supporting raft.

FIG. 18 shows an additional or replacement load supporting raft (2A). It is obvious that in forms of the invention there may be only a single load supporting raft (2) and this raft may be reused. In other forms of the invention there may be several rafts.

Figure 19:
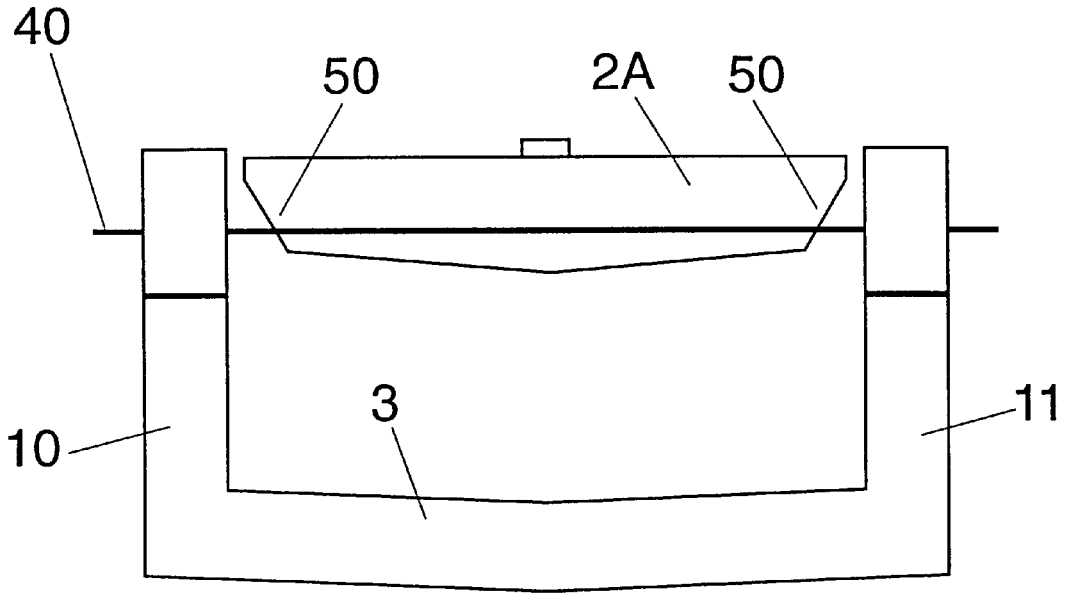
FIG. 19 shows an end elevation of the load supporting raft as shown in FIG. 18 when positioned within a submerged floating dock.

As shown in FIG. 19 the load supporting raft (2A) is positioned within the submerged main ballast vessel (3). The load supporting raft (2A) is then sunk by for example the opening of openings (50) for example valves (50).

Figure 20:
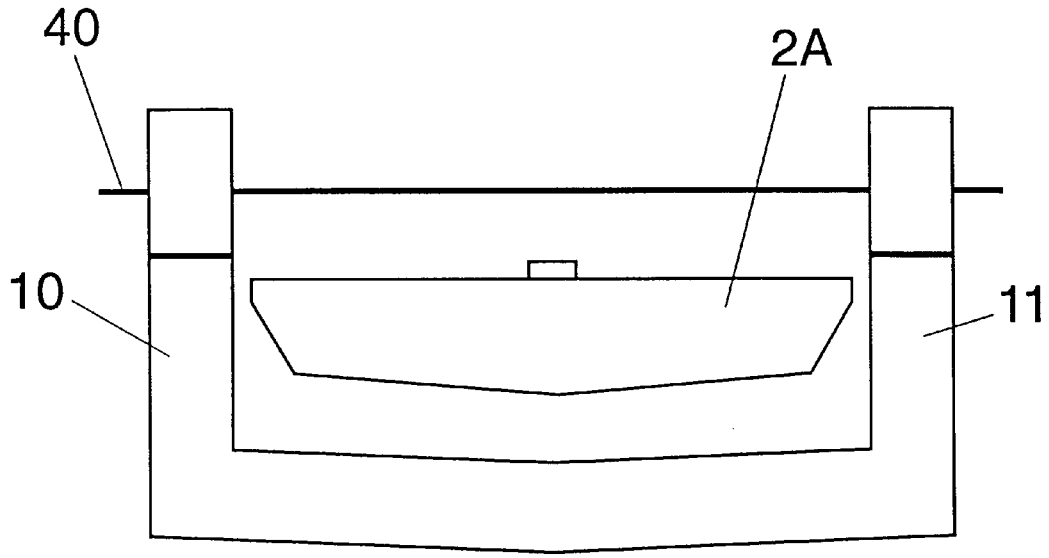
FIG. 20 is an end elevation showing the partial submergent of the load supporting raft within the submerged floating dock.
Figure 21:
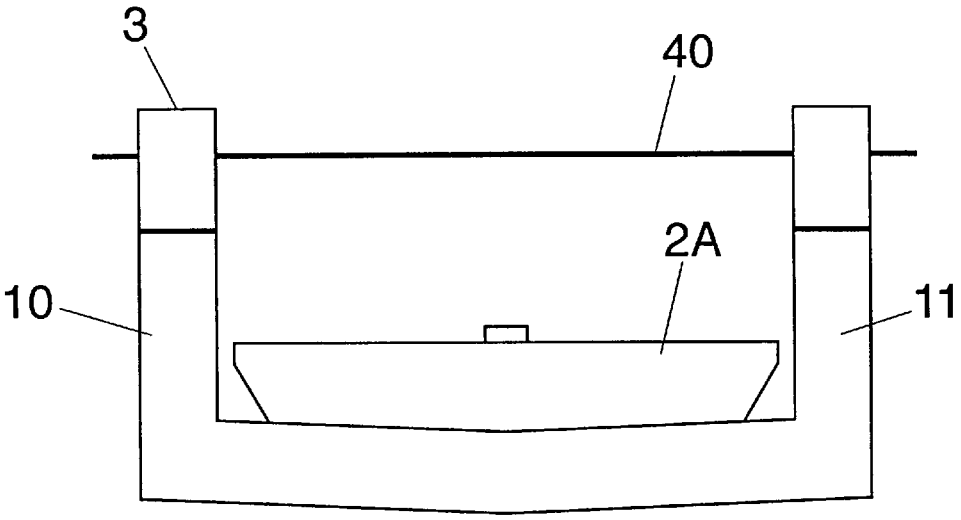
FIG. 21 shows an end elevation of the positioning of a replacement load supporting raft within the submerged floating dock.

The load supporting raft (2A) then sinks so as to contact said main ballast vessel (3). This is illustrated in FIGS. 20 and 21.

Figure 22:
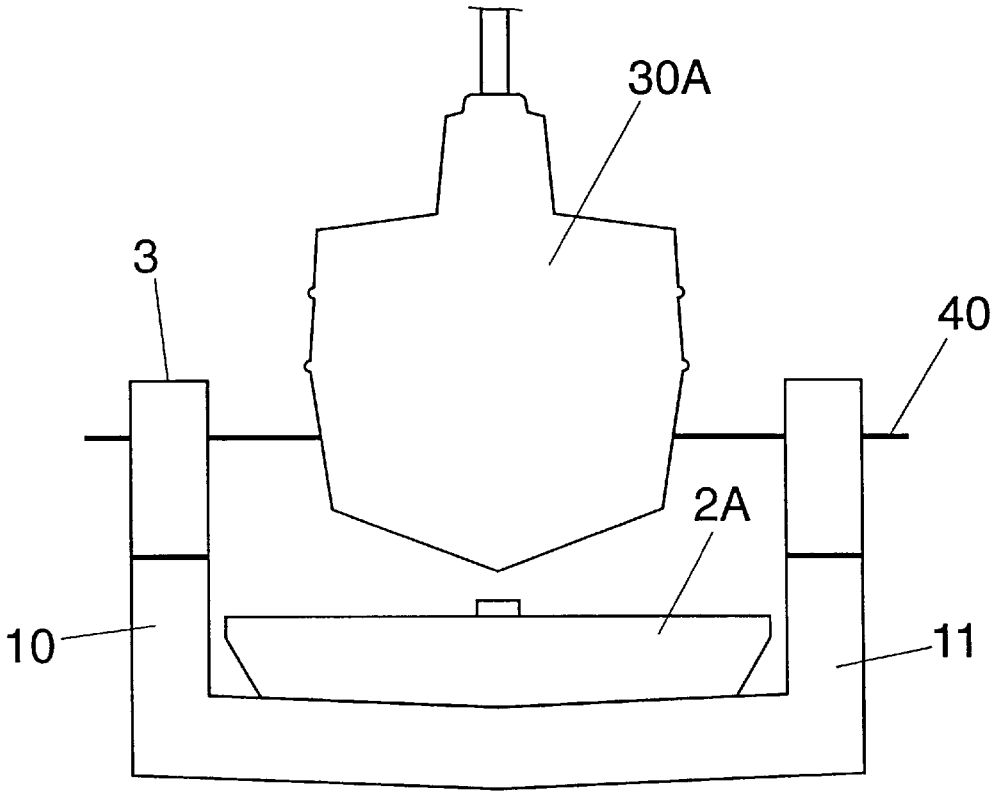
FIG. 22 shows the positioning of a vessel within said floating dock over said load supporting raft.

FIG. 22 shows the cycle back at the stage as illustrated in FIG. 9 with a vessel to be floated (30A) contained within a floating dock (1).

I claim:

1. A floating dock comprising: at least one load supporting raft, and a main ballast vessel having a central support section adapted for supporting said load supporting raft thereon and having means for centering said load supporting raft when docking and undocking, said load supporting raft and said main ballast vessel having separately variable buoyancy, said load supporting raft being capable of buoyantly supporting the total vessel weight to be supported by said floating dock, such that once floated, said main ballast vessel is no longer required for support.

2. A floating dock according to claim 1, wherein said means for centering said load supporting raft comprises a concave upper surface on said central support section.

3. A floating dock according to claim 2, wherein said load supporting raft is formed with a convex bottom surface adapted to fit into said concave upper surface on said central support section.

4. A floating dock comprising: at least one load supporting raft, and a main ballast vessel having a central support section adapted for supporting said load supporting raft thereon and having attached stabilizing means on either side of said central support section, said load supporting raft and said main ballast vessel having separately variable buoyancy, said load supporting raft being capable of buoyantly supporting the total vessel weight to be supported by said floating dock, such that once floated, said main ballast vessel is no longer required for support.

5. A floating dock comprising: at least one load supporting raft provided with attachment points for attaching a vessel supported thereon to said load supporting raft, and a main ballast vessel having a central support section adapted for supporting said load supporting raft thereon, said load supporting raft and said main ballast vessel having separately variable buoyancy, said load supporting raft being capable of buoyantly supporting the total vessel weight to be supported by said floating dock, such that once floated, said main ballast vessel is no longer required for support.

6. A floating dock comprising: at least one load supporting raft, and a main ballast vessel having a central support section adapted for supporting said load supporting raft thereon, said load supporting raft and said main ballast vessel having separately variable buoyancy provided by the input of compressed air into at least a tank in said main ballast vessel, said load supporting raft being capable of buoyantly supporting the total vessel weight to be supported by said floating dock, such that once floated, said main ballast vessel is no longer required for support.

7. A method of dry docking a vessel using a floating dock comprising: at least one load supporting raft, and a main ballast vessel having a central support section adapted for supporting said load supporting raft thereon, said load supporting raft and said main ballast vessel having, separately variable buoyancy, said load supporting raft being capable of buoyantly supporting the total vessel weight to be supported by said floating dock, such that once floated, said main ballast vessel is no longer required for support, said method comprising the steps of:

(i) supporting said load supporting raft on said central support section of said main ballast vessel;

(ii) submerging said main ballast vessel and said load supporting raft to a predetermined level;

(iii) floating a vessel to be dry docked over said load supporting raft;

(iv) increasing the buoyancy of said floating dock so as to support said vessel on said load supporting raft and raise said vessel out of the water while maintaining said floating dock in a stable condition;

(v) increasing the buoyancy of said load supporting raft by a sufficient amount to support the full weight of said vessel independent of said main ballast vessel;

(iv) resubmerging said main ballast vessel to a predetermined level; and (vii) floating said load supporting raft with the supported vessel away from said main ballast vessel, thus allowing said main ballast vessel to be used with further load supporting rafts.

8. A method of dry docking a vessel according to claim 7, wherein said step of increasing the buoyancy of said floaoting dock is achieved by the ingress of compressed air into at least a tank in said main ballast vessel, thereby forcing out water contained therein.

9. A method of dry docking a vessel according to claim 7, wherein said step of increasing the buoyancy of said load supporting raft involves allowing water contained in said load supporting raft to drain therefrom as said load supporting raft is raised from the water with the raising of said vessel out of the water.

10. A method of dry docking a vessel according to claim 7, where in said vessel is attached to said load supporting raft prior to resubmerging said main ballast vessel.

11. A method of dry docking a vessel according to claim 7, wherein a number of load supporting rafts are provided.

12. A method of dry docking a vessel using a floating dock comprising: at least one load supporting raft, and a main ballast vessel having a central support section adapted for supporting said load supporting raft thereon, said load supporting raft and said main ballast vessel having separately variable buoyancy provided by the input of compressed air into at least a tank in said main ballast vessel, said load supporting raft being capable of buoyantly supporting the total vessel weight to be supported by said floating dock, such that once floated, said main ballast vessel is no longer required for support, said method comprising the steps of:

(i) supporting said load supporting raft on said central support section of said main ballast vessel;

(ii) submerging said main ballast vessel and said load supporting raft to a predetermined level;

(iii) floating a vessel to be dry docked over said load supporting raft;

(iv) increasing the buoyancy of said floating dock by the input of compressed air into at least a tank in said main ballast vessel, so as to support said vessel on said load supporting raft and raise said vessel out of the water while maintaining said floating dock in a stable condition by said separately variable levelling system;

(v) increasing the buoyancy of said load supporting raft by a sufficient amount to support the full weight of said vessel independent of said main ballast vessel;

(iv) resubmerging said main ballast vessel to a predetermined level; and (vii) floating said load supporting raft with the supported vessel away from said main ballast vessel, thus allowing said main ballast vessel to be used with further load supporting rafts.

* * * * *